US008152250B2

(12) United States Patent
Aguilar Ante et al.

(10) Patent No.: US 8,152,250 B2
(45) Date of Patent: Apr. 10, 2012

(54) SYNCHRONIZING/STABILIZING SYSTEM AND SELF MOVING MECHANISM FOR DRAWER APPLICATIONS

(75) Inventors: Jose Roberto Aguilar Ante, Mexicali (MX); Jorge Fermín Gianola Fernández, Mexicali (MX); Rafael Celaya Basilio, Mexicali (MX)

(73) Assignee: Accuride International, Inc., Santa Fe Springs, CA (US)

( * ) Notice: Subject to any disclaimer, the term of this patent is extended or adjusted under 35 U.S.C. 154(b) by 127 days.

(21) Appl. No.: 12/537,975

(22) Filed: Aug. 7, 2009

(65) Prior Publication Data

US 2010/0219727 A1 Sep. 2, 2010

Related U.S. Application Data

(60) Provisional application No. 61/087,073, filed on Aug. 7, 2008.

(51) Int. Cl.
*A47B 95/00* (2006.01)

(52) U.S. Cl. ..... 312/331; 312/334.7

(58) Field of Classification Search ..... 312/331, 312/334.1, 334.7, 334.8, 319.1; 384/22
See application file for complete search history.

(56) References Cited

U.S. PATENT DOCUMENTS

| | | | | | |
|---|---|---|---|---|---|
| 399,752 | A | * | 3/1889 | Horrocks | 312/331 |
| 591,134 | A | * | 10/1897 | Howard | 312/331 |
| 905,544 | A | * | 12/1908 | Lambert et al. | 312/319.1 |
| 3,323,853 | A | * | 6/1967 | Stark | 312/331 |
| 3,378,321 | A | * | 4/1968 | Sobel et al. | 312/215 |
| 3,687,505 | A | * | 8/1972 | Fall et al. | 384/18 |
| 3,722,964 | A | * | 3/1973 | Chitester et al. | 384/18 |
| 3,794,401 | A | * | 2/1974 | Dean et al. | 312/323 |
| 4,324,439 | A | * | 4/1982 | Hagen et al. | 384/18 |
| 4,351,575 | A | * | 9/1982 | Rock et al. | 384/18 |
| 4,600,254 | A | | 7/1986 | Whalen | |
| 4,925,258 | A | * | 5/1990 | Ludwig et al. | 312/323 |
| 5,104,178 | A | * | 4/1992 | Bienert | 296/216.08 |
| 5,564,807 | A | * | 10/1996 | Rock et al. | 312/331 |
| 6,170,927 | B1 | * | 1/2001 | Dykstra et al. | 312/220 |
| 6,588,834 | B2 | * | 7/2003 | Maeta et al. | 296/216.04 |

(Continued)

FOREIGN PATENT DOCUMENTS

AT 008 111 U1 2/2006

(Continued)

OTHER PUBLICATIONS

English Machine Translation of German Patent DE 20 2006 000 711 U1, published on May 11, 2006.

(Continued)

*Primary Examiner* — Darnell Jayne
*Assistant Examiner* — Kimberly S Wright
(74) *Attorney, Agent, or Firm* — Christie, Parker & Hale, LLP

(57) ABSTRACT

A synchronizing device for use with a pair of drawer slide assemblies where each drawer slide assembly has at least a first slide member moveable relative to a second slide member, and includes a first stabilization element configured to be coupled to the second slide member of one of the slide assemblies, and a second stabilization element configured to be coupled to the second slide member of the other slide assembly. A linking element extends transverse to an extension direction of the slide assemblies and synchronizes movements of the first slide members of the slide assemblies.

34 Claims, 12 Drawing Sheets

U.S. PATENT DOCUMENTS

| | | | | |
|---|---|---|---|---|
| 6,752,478 | B1 * | 6/2004 | Francz | 312/334.1 |
| 6,923,518 | B2 * | 8/2005 | Kim | 312/334.4 |
| 7,104,691 | B2 * | 9/2006 | Chi | 384/21 |
| 7,282,884 | B2 * | 10/2007 | Huber et al. | 318/646 |
| 7,430,937 | B2 * | 10/2008 | Rotter et al. | 74/422 |
| 7,594,707 | B2 * | 9/2009 | Kunkle et al. | 312/402 |
| 7,780,251 | B2 * | 8/2010 | Dubach et al. | 312/319.7 |
| 2002/0011766 | A1 * | 1/2002 | Kim et al. | 312/319.1 |
| 2005/0160854 | A1 * | 7/2005 | Rotter | 74/422 |
| 2006/0250059 | A1 * | 11/2006 | Lemm | 312/331 |
| 2007/0144408 | A1 | 6/2007 | Rotter | |
| 2008/0191591 | A1 * | 8/2008 | Blucher et al. | 312/319.1 |
| 2008/0211365 | A1 * | 9/2008 | Moll et al. | 312/319.1 |
| 2009/0261698 | A1 * | 10/2009 | Cabal Velarde et al. | 312/334.8 |
| 2010/0283365 | A1 * | 11/2010 | Chen | 312/334.4 |

FOREIGN PATENT DOCUMENTS

| | | | |
|---|---|---|---|
| DE | 20 2006 000 711 | U1 | 5/2006 |
| EP | 1 649 782 | A2 | 10/2007 |
| WO | WO 2006029894 | * | 3/2006 |

OTHER PUBLICATIONS

English Patent Abstract from esp@cenet database of European Patent 1 649 782, published on Oct. 17, 2007, related to AT 008 111 U1, published on Feb. 15, 2006.

PCT International Search Report and Written Opinion of the International Search Authority, dated Nov. 19, 2009, for International Application No. PCT/US2009/053197.

International Preliminary Report on Patentability for International Application No. PCT/US09/53197, Filed Aug. 7, 2009, Dated Apr. 6, 2011; 24 Pages.

* cited by examiner

SYNCHRONIZING/STABILIZING SYSTEM AND SELF MOVING MECHANISM FOR DRAWER APPLICATIONS

CROSS-REFERENCE TO RELATED APPLICATION(S)

This application claims the benefit of the filing date of Provisional Patent Application No. 61/087,073, filed Aug. 7, 2008, incorporated by reference herein.

BACKGROUND

The present disclosure relates generally to drawer slide assemblies, and more particularly to drawer slide assemblies with anti-racking features.

A common problem with wide drawers is the lack of stability during opening and closing of the drawer. This condition may occur when the drawer is pulled or pushed far from its center. If a drawer is pushed or pulled from one side, the other side will tend to either remain on its current position or move in the opposite direction. This causes a lack of stability in the drawer performance.

Conventional antirack devices may use a toothed rack and pinion system to provide side to side synchronization. The rack is commonly placed or attached to the stationary member of the slide, and the pinion is attached to the sliding member. As the sliding members goes out of the stationary member the pinion rotates over the rack. The drawer movement is synchronized and stabilized since both slides of the drawer have rack and pinion systems and they are connected by a link shaft.

Some of the drawbacks of rack and pinion systems are: the amount of noise produced when the pinion is engaging the rack, the accumulation of dirt on the rack since it is not concealed and the limitation on the drawer travel since it is limited to the extension of the rack and the rack is limited by the depth of the cabinet. Another drawback of conventional rack and pinion systems is their complicated installation method and the long time needed to achieve it. The pinion has to be aligned when the slide is being installed to the cabinet and it can be done incorrectly since there's only a visual aid to do it. The synchronization of the system can take a long time and more than one person.

A disadvantage of many existing antirack systems is that the connecting shaft travels along with the drawer. This leaves the shaft visible and hard to hide or conceal. It also makes the system difficult to automate.

SUMMARY

In accordance with an aspect of the disclosure, a synchronizing device for use with a pair of drawer slide assemblies where each drawer slide assembly has at least a first slide member moveable relative to a second slide member, includes a first stabilization element configured to be coupled to the second slide member of one of the slide assemblies, and a second stabilization element configured to be coupled to the second slide member of the other slide assembly. A linking element extends transverse to an extension direction of the slide assemblies and synchronizes movements of the first slide members of the slide assemblies.

In accordance with another aspect of the disclosure, a synchronizing device for use with a pair of drawer slide assemblies where each drawer slide assembly has at least a first slide member moveable relative to a second slide member, and includes a first stabilization element and a second stabilization element. The first stabilization element is coupled to the second slide member of one of the slide assemblies. The second stabilization element is coupled to the second slide member of the other slide assembly. Each of the stabilization elements includes a connecting element, a flexible member, and a sprocket. Each connecting element is coupled to the corresponding first slide member such that the connecting element and the first slide member are moveable together. The flexible member is coupled to the connecting element such that the flexible member and the connecting element are moveable together. The sprocket is coupled to the flexible member such that the flexible member and the sprocket are moveable together. The synchronizing device also includes a linking element that couples the sprocket of the first stabilization element and the sprocket of the second stabilization element to synchronize movements of the first slide members.

The flexible member of each stabilization element includes a plurality of apertures that engage with a plurality of projections or teeth on the sprocket of the corresponding stabilization element. The connecting element of each stabilization element may have at least one pin which engages with one of the apertures of the flexible member of the corresponding stabilization element. The sprocket of each stabilization element has a center shaft with a cavity and a slot. Each stabilization element has an adapter with a key portion that is shaped to be received in the slot of the cavity. Each of the adapters connects to a corresponding end of the linking element. The adapter is then inserted in the cavity of the corresponding sprocket to connect the linking element to the sprockets of the stabilization elements.

The flexible member and the sprocket of each stabilization element are housed in a housing. A carrier element is provided in each housing, which can extend from the inside of the housing to the outside of the housing to support the flexible member when the flexible member extends outside of the housing. A spring device in each housing returns the carrier element from the outside of the housing to the inside of the housing. Each housing also includes a slot gap that receives at least a portion of the connecting element. Furthermore, each housing has a guide path configured to guide movement of the flexible member along the guide path.

With any of the aforementioned embodiments a self moving mechanism may be coupled to at least one of the slide assemblies for moving the first slide member relative to the second slide member. In an exemplary embodiment, a self moving device includes a piston which may be actuated by a spring or other energy source to move an actuation element including an arm which moves the flexible member or second coupling element of a stabilization element. The piston slides within a piston housing which pivots during actuation. A dampener may also be coupled to the piston housing for dampening the movement of piston housing.

DETAILED DESCRIPTION

Figure 1:
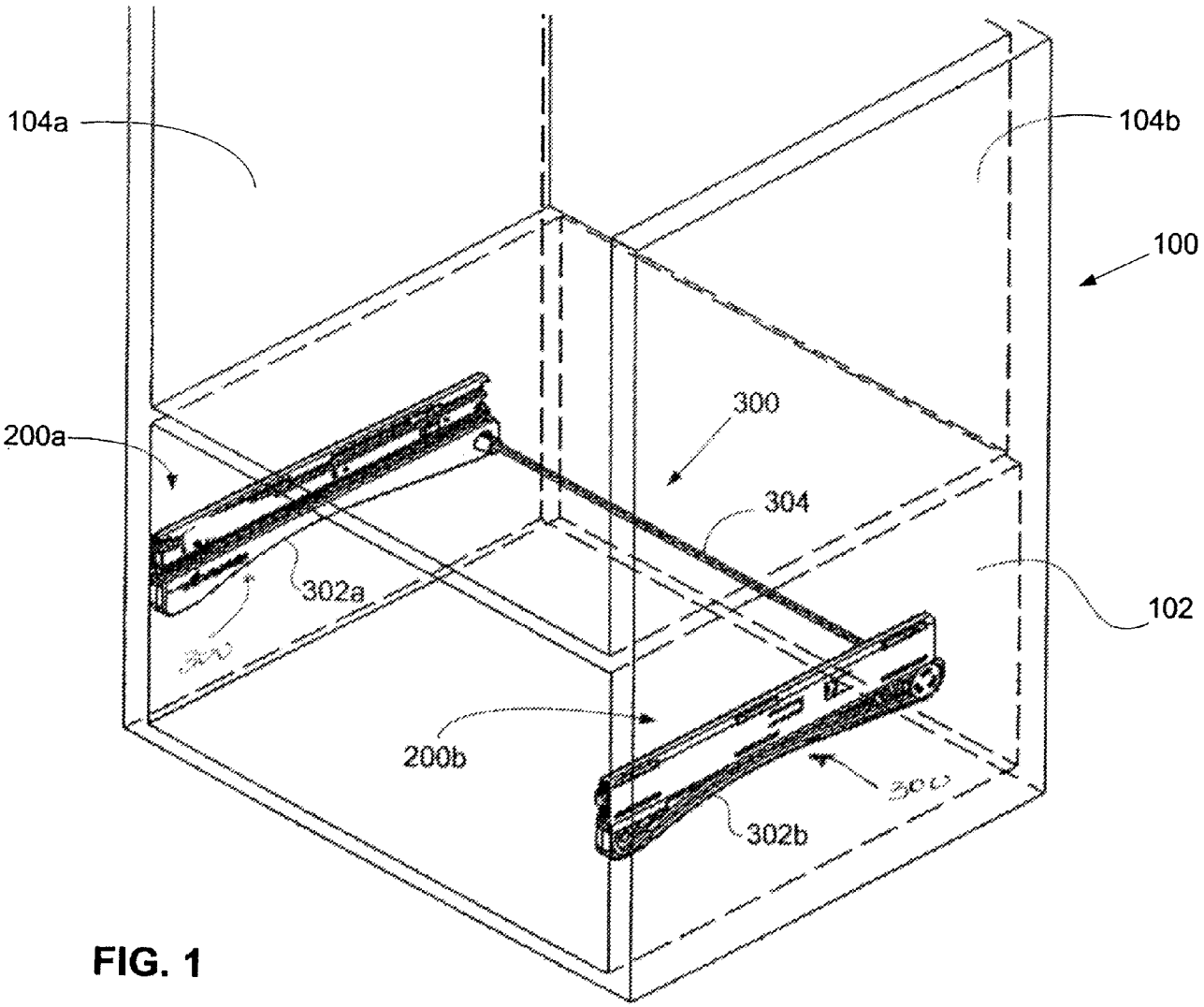
FIG. 1 shows a cabinet and a drawer coupled to the cabinet with drawer slide assemblies in accordance with the disclosure.

FIG. 1 shows a cabinet structure 100 with a drawer 102 generally within and coupled to the cabinet structure by drawer slides 200*a* and 200*b*. The cabinet structure 100 generally provides a housing for storage of items and may be a refrigerator unit with one or more refrigerator drawers, a wood, plastic, or metallic cabinet with one or more storage drawers, or may be a rack having electronic or computer equipment mounted therein. As illustrated in FIG. 1, the drawer slides 200*a* and 200*b* are in the interior of the cabinet structure 100 and coupled to opposing side walls 104*a* and 104*b* of the cabinet structure, respectively. In the embodiments where the drawer 102 is an electronic or computer equipment, the cabinet structure 100 may be in the form of a frame structure or rack (not shown) having support beams to which the drawer slides 200*a* and 200*b* can be mounted. The use of the drawer slides 200*a* and 200*b* generally allows for easy extension of the drawer 102 from the cabinet structure 100.

FIG. 1 shows a synchronizing device 300 according to the disclosure which includes two stabilization elements 302*a* and 302*b* connected with a linking or synchronizing element or as may be referred to herein for convenience as a synchronizing element 304 in order to synchronize the movement of the drawer slides 200*a* and 200*b*. The stabilization element 302*a* is connected to the drawer slide 200*a* and the stabilization element 302*b* is connected to the drawer slide 200*b*. When the drawer slides 200*a* and 200*b* are extended or closed in order to open or close the drawer 102, respectively, the synchronizing device 300 synchronizes the movement of the drawer slides 200*a* and 200*b*. The components and operation of the stabilization elements 302*a* and 302*b* are described in detail below with reference to one of the drawer slides and one of the stabilization elements. Accordingly, the drawer slides may be generally referred to with reference number 200 and stabilization elements may be generally referred to with reference number 302.

Referring to FIGS. 2-6, the stabilization element 302 includes a housing 306 that is connected to the drawer slide 200 either directly or through various coupling elements (not shown). The connection of the housing 306 to the drawer slide 200 may depend on the type of drawer slide being used. The housing 306 is substantially below the drawer slide 200. The housing 306 may be placed above the slide if the application requires it. The synchronizing element 304 (shown in FIG. 1), which may be in the form of a bar or a shaft, links the operative components of the stabilization elements 302*a* and 302*b* (shown in FIG. 1) such that movement of either drawer slide 200 results in corresponding movement of the opposing drawer slide. The synchronizing element 304 is located about a rear portion of the housing 306.

Figure 2:
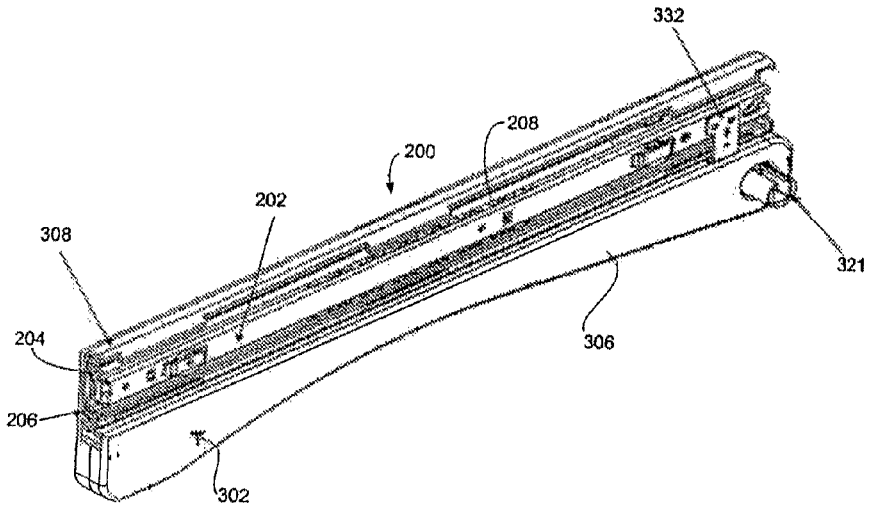
FIGS. 2 and 3 show isometric views of a drawer slide assembly and a stabilization element in accordance with one embodiment of the disclosure with the drawer slide assembly shown in the closed position and a fully extended position, respectively.
Figure 3:
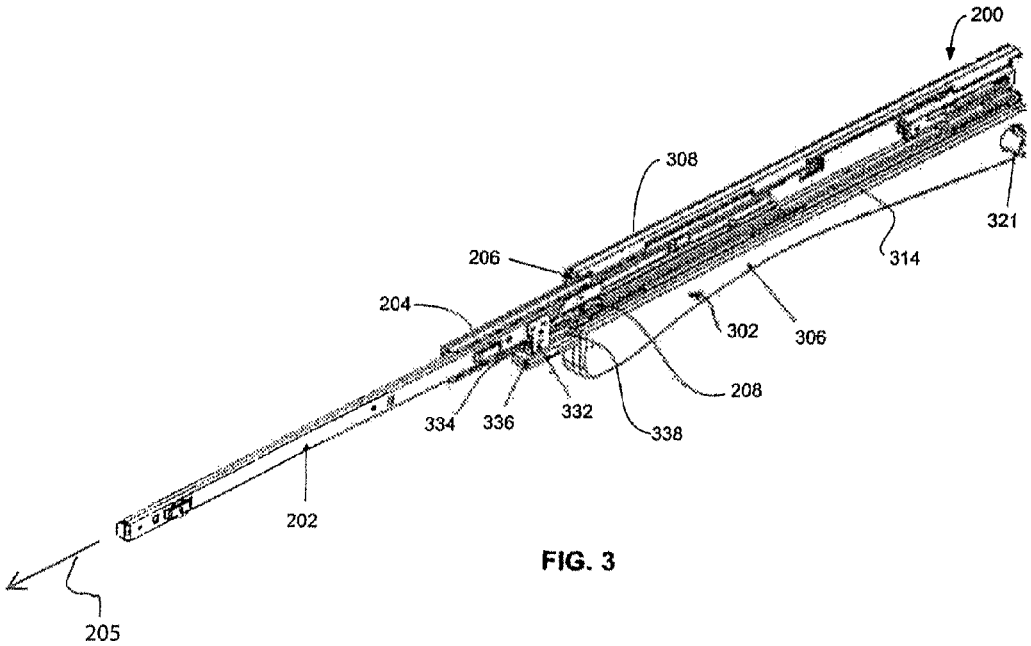

The drawer slide 200 is a three-member telescopic slide with an inner slide member 202 nested largely within an intermediate slide member 204 (shown in FIGS. 2 and 3), which in turn is nested largely within an outer slide member 206, with the slide members coupled by way of ball bearings 208 (shown in FIGS. 2 and 3). The outer slide member 206 is generally coupled to a cabinet 100 or rack, and the inner slide member 202 is generally coupled to a drawer or box that may contain a broad range of items, such as for example, food, tools, computer equipment, etc., depending on the application. Accordingly, the outer slide member 206 remains stationary while the intermediate slide member 204 and the inner slide member 202 are moveable or extendable along a direction 205. However, as described below, the drawer slide 200 can be a reverse mount drawer slide where the inner slide member 202 is coupled to the cabinet or rack 100 while the intermediate slide member 204 and the outer slide member 206 are moveable or extendable.

As is common with telescopic drawer slides, each slide member includes a longitudinal web with raceways formed on opposing sides of the length of the longitudinal web. Ball bearings 208 run in the raceways and allow the slides to be in rolling engagement. Generally the inner slide member is extendable from the intermediate slide member, and the intermediate slide member is extendable from the outer slide member. In various embodiments, however, other types of drawer slides with two or more members that slide relative to each other may be used. The drawer slide 200 and the housing 306 may be connected by any type of coupling mechanisms known in the art. In the embodiment of FIGS. 2-6, the housing 306 includes a sleeve 308 configured to receive the outer slide member 206 therein. The drawer slide 200 is shown in the closed position in FIG. 2 and a fully extended position in FIG. 3.

Figure 4:
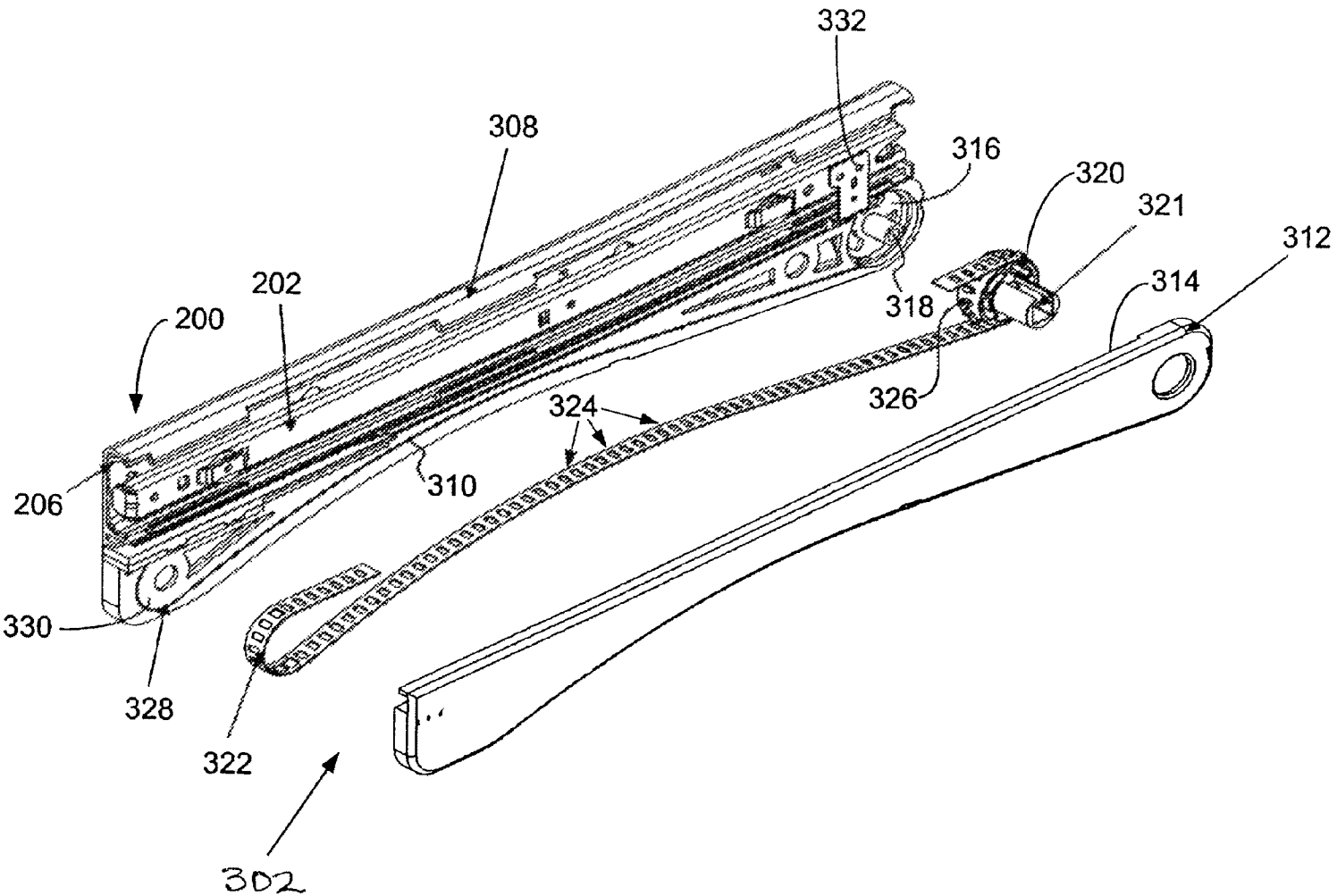
FIG. 4 shows an exploded view of the drawer slide assembly and the stabilization element of FIG. 2.
Figure 5:
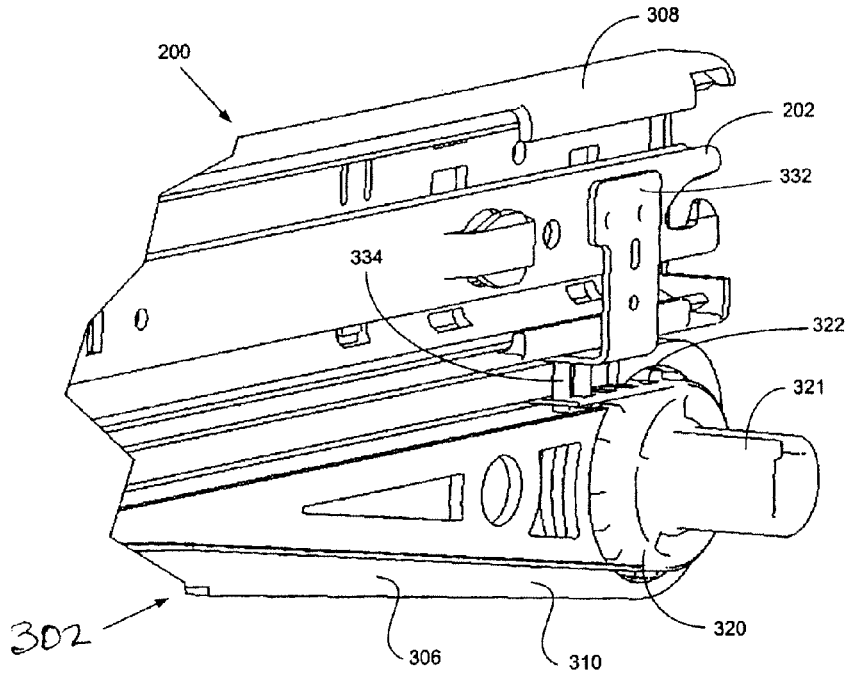
FIGS. 5 and 6 show portions of a drawer slide assembly and a housing of the stabilization element in accordance with the present disclosure.
Figure 6:
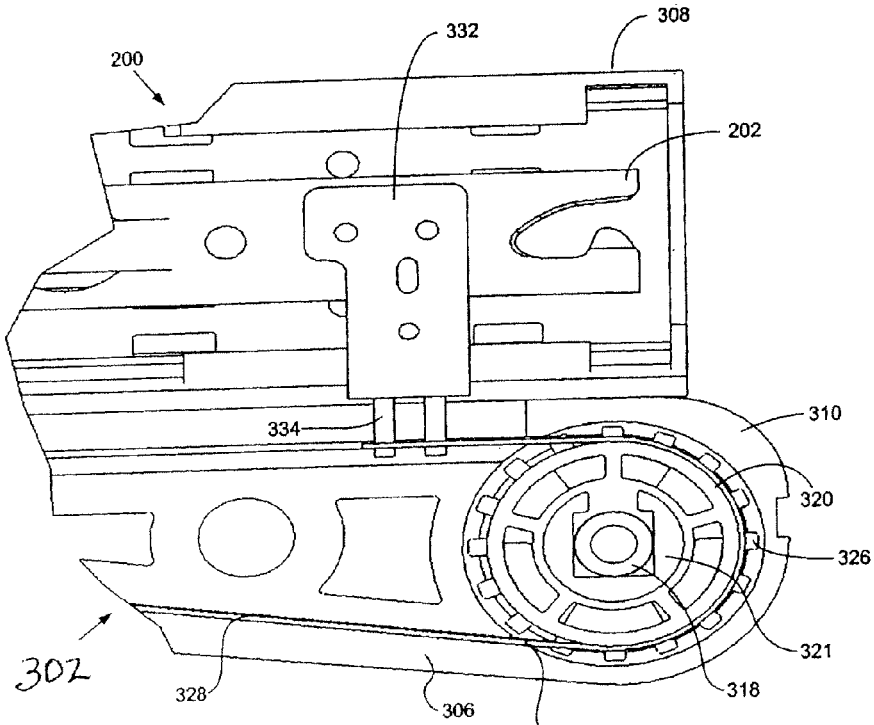

Referring to FIG. 4, an exemplary embodiment of the stabilization element 302 is shown in an exploded view in order to show details of the components housed in the housing 306. The housing 306 includes a base 310 and a cover 312. The cover 312 mates with the base 310 to form the housing 306. The housing 306 includes a slot gap 314 between the base 310 and the cover 312 facing the inner slide member 202. The rear portion of the base 310 includes a recess 316, which may be generally circular. A mounting shaft 318 projects from the base 310 and is configured to receive a driven element in the form of a sprocket 320. The shaft 318 may be centered in the recess 316. The stabilization element 302 further includes a driving element in the form of an elongated flexible member 322 configured to engage an element such as for example a sprocket 320, a wheel, a gear or a pinion, to rotate such element 320 about the shaft 318. For illustrative purposes, the invention is described herein in relation to a sprocket 320. However, other elements that can couple with the flexible member 322, for being driven by or for driving, the flexible member 322 may be also be used. The elongated flexible member may be a belt, a chain, a chord, or any type of strip-shaped material that exhibits flexibility. In the disclosed examples, the elongated flexible member 322 is in the form of a belt or chain 322 having a plurality of perforations or apertures 324 arranged along its length. The apertures 324 are configured to receive the projections or teeth 326 of the sprocket 320. However, a belt, cord, or other types of elongated flexible members can be used to engage the sprocket 320 to drive, or be driven by, the sprocket 320. The flexible members may not have apertures and may engage the sprocket (or other element) solely by friction. For illustrative purposes, the flexible member 322 is described herein as a chain 322. The chain 322 can drive the sprocket 320, where movement of the chain 322 causes rotational movement of the sprocket 320 about the mounting shaft 318. Conversely, rotational movement of the sprocket 320 can move the chain 322.

The housing 306 includes a guide channel 328 having a channel depth sized to accommodate the chain 322 therein and having a channel width slightly larger than the thickness of the chain 322 in order to allow the chain 322 to freely move therein and yet prevent the chain 322 from waving and flexing. In the exemplary embodiment, an upper portion of the guide channel 328 runs from above the recess 316 to a forward end of the housing 306 along a length of the housing 306. A lower portion of the guide channel 328 runs from below the recess 316 to a forward end of the housing 306 along the length of the housing 306. At the forward end of the housing 306, the guide channel 328 may or may not include a semicircular. return 330 which joins the upper portion of the guide channel to the lower portion of the guide channel if needed by the application.

Operative coupling between the drawer slide 200 and the stabilization element 302 is provided by a connecting element 332 which in an exemplary embodiment is in the form of a bracket 332. In the embodiment of FIGS. 2-6, the connecting element 332 is attached to the inner slide member 202. The connecting element 332 includes two pins 334 (shown in FIGS. 5-6) that extend toward the housing 306 and engage in two of the apertures 324 of the chain 322. The pins 334 may be rivets, for example, extending from a flange of the connecting element 332. Because the connecting element 332 is attached to the inner slide member 202, movement of the inner slide member 202 moves the connecting element 332, which in turn drives the chain 322. The chain 322 then rotates the sprocket 320. Conversely, rotation of the sprocket 320 drives the chain 322, which in turn drives the connecting element 332 to move the inner slide member 202.

Referring to FIG. 3 the inner slide member 202 extends beyond the outer slide member 206 and the housing 306 when the drawer slide 200 is in the fully extended position. The drawer slide, therefore, may be considered a full or over travel slide, with the inner slide member 202, and therefore any drawer carried by the inner slide member 202, extending equal to or beyond the confines of a cabinet structure.

Referring to FIGS. 3, 7*b*, 11-13, each stabilization element 302 includes an extension element, which is referred to herein as the carrier 336 for supporting the chain 322 when the inner slide member 202 over travels or travels beyond the fully extended position. The carrier 336 is located about a forward end of the upper portion of the guide channel 328. When the drawer slide 200 reaches its fully extended position, the carrier 336 indexes partially out of the housing 306. The carrier 336 is pushed by the chain 322 or by any other element (such as the pins 334) attached to the connecting element 332, with the connecting element 332 being attached to the inner slide member 202. The function of the carrier 336 is to provide support to the chain 322 and to prevent the chain 322 from flexing and/or waving when the chain 322 extends out of the guide channel 328 of the housing 306. The carrier will also maintain synchronization of the slides when the slides are in an over-travel, i.e., over-extended position by allowing the connecting element to move the chain when the inner slide member is in the over extended position.

Figure 11:
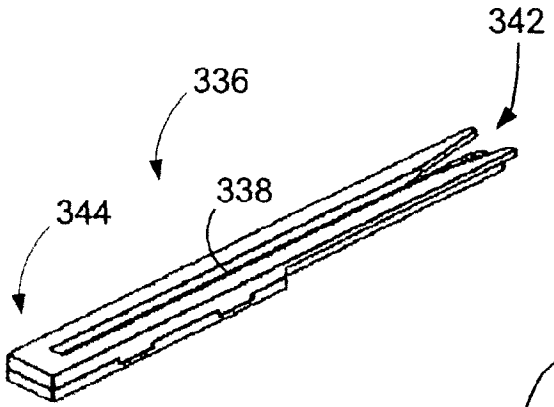
FIGS. 11-13 are isometric, top, and side views, respectively, of an exemplary carrier of the present disclosure.
Figure 12:
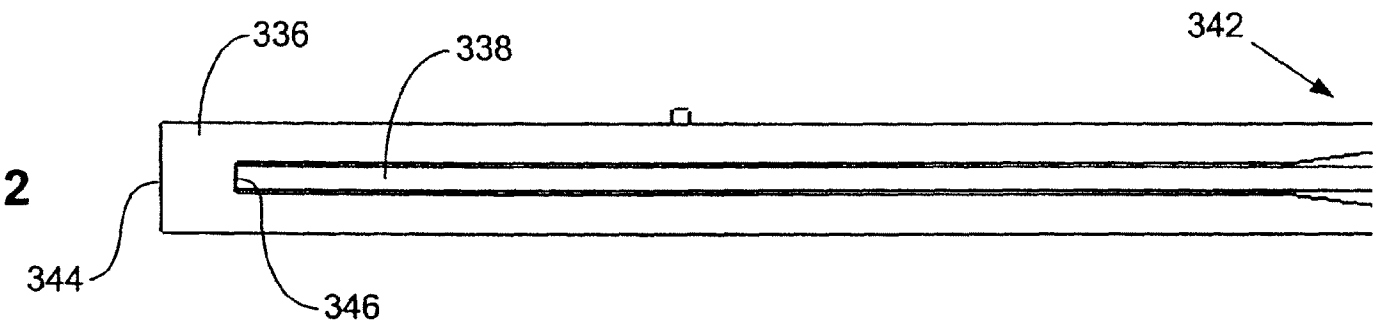
Figure 13:
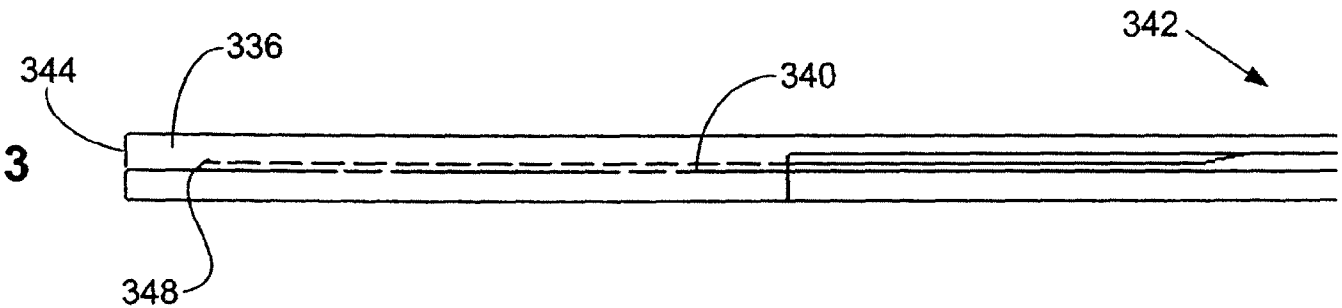

In an exemplary embodiment, as shown in FIGS. 11-13, the carrier 336 has a top slot 338 for receiving the pins 334 of the connecting element 332 and a side slot 340 for receiving the chain 322. The top slot 338 extends from a rear end 342 of the carrier 336 towards a front end 344 of the carrier 336. The top slot 338, however, does not extend to the front end 344 of the carrier, thereby defining a first abutment 346 (shown in FIG. 12). Similarly, the side slot 340 does not extend to the front end 344 of the carrier 336 defining a second abutment 348 (shown in FIG. 13). The first and second abutments may be the same abutment. As the inner slide member 202 is reaching full extension, the pins 334 enter the top slot 338 of the carrier 336 while the chain 322 enters the side slot 340. As the inner slide member 202 continues to extend, one of the pins 334 abuts the first abutment 346 and/or a front end 344 of the carrier 336, and/or the chain 322 abuts the second abutment 348 such that further extension of the inner slide member 202 causes the carrier 336 to extend beyond the housing 306. The extended carrier 336 serves to support the portion of the chain 322 that extends beyond the housing 306 as discussed in detail above. When the carrier 336 is pushed out of the housing 306, it moves forward until the inner slide member 202 reaches its fully extended position. As the inner slide member 202 and the connecting element 332 are moving forward, the chain 322 is pulled by the pins 334 on the connecting element 332. The chain 322 runs through the guide channel 328. When the chain 322 is sliding through the guide channel 328, it rotates the sprocket 320 to provide traction to the system. When the inner slide member 202 is pushed from its fully extended position toward a closed position, the inner slide member 202 moves the chain 322 via the connecting element 332 to thereby rotate the sprocket 320. The sprocket 320 then rotates the synchronizing element 304, which rotates the sprocket 320 of the opposing stabilization element 302 which moves its corresponding chain and thus, synchronizes the movements of the inner slide members 202. The carrier 336 is then pulled back inside the housing 306 by a spring 350.

Figure 7A:
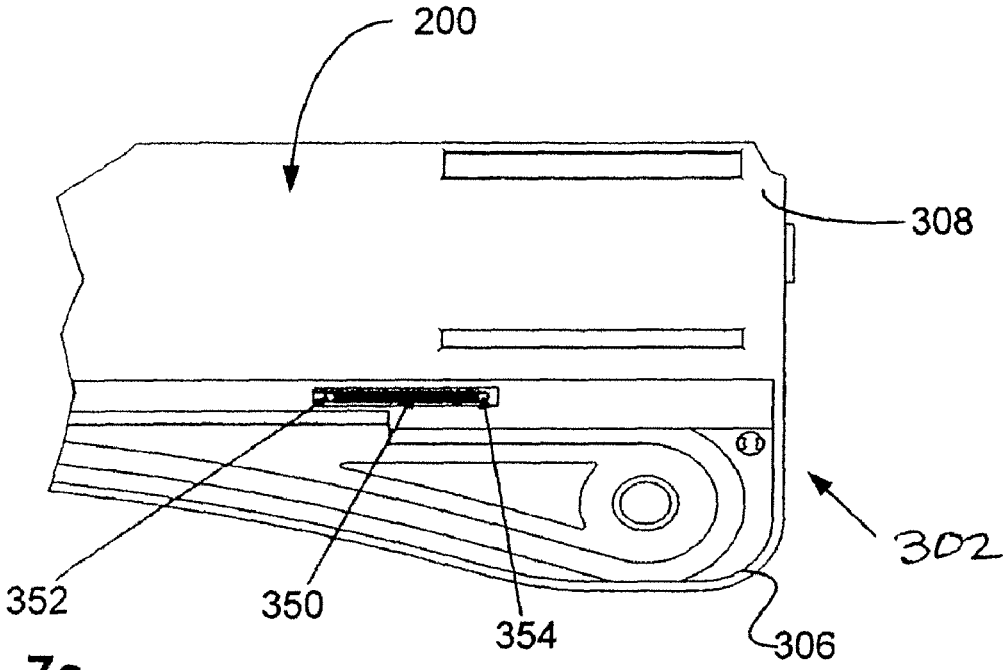
FIG. 7*a* shows a side view of the drawer slide and the stabilization element of FIG. 2 viewed from the cabinet side.

FIG. 7*a* shows the drawer slide 200 and housing 306, including the spring 350 for return of the carrier 336, with the drawer slide 200 in a closed position. The spring 350 is adjacent a portion of the carrier 336 in the closed position of the drawer slide 200. One end of the spring 350 is coupled to a pin 352 on the housing 306, another end of the spring is coupled to another pin 354 on the carrier 336.

Figure 7B:
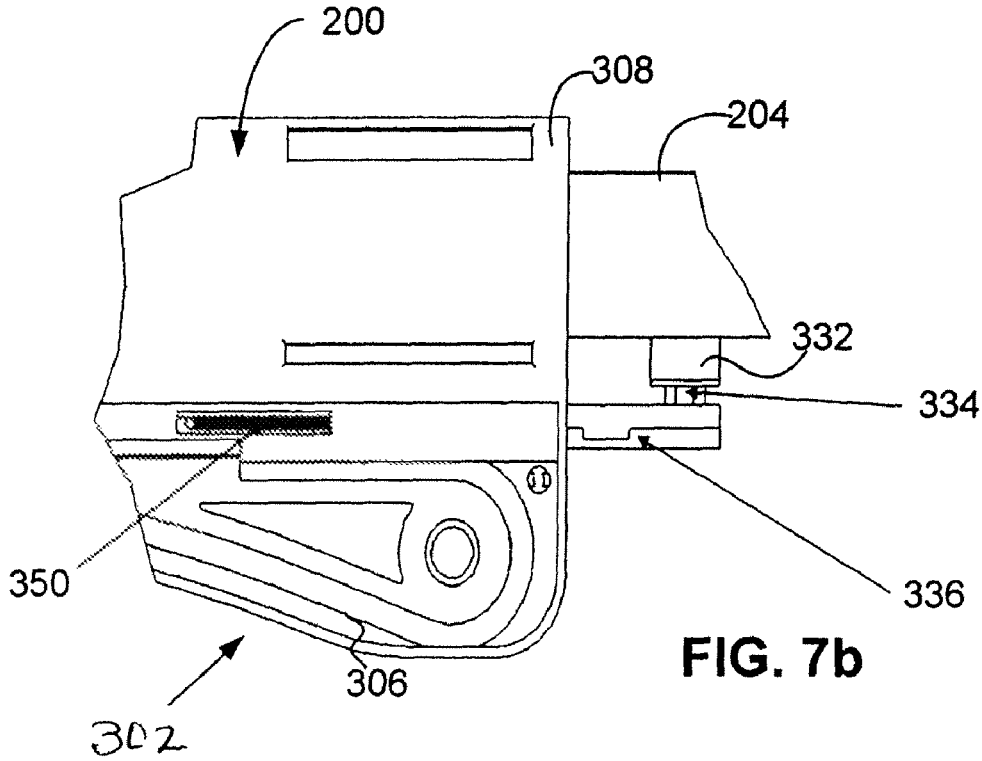
FIG. 7*b* shows a side view of the drawer slide and the stabilization element of FIG. 3 viewed from the cabinet side.

FIG. 7*b* shows a portion of the drawer slide 200 and the housing 306, with the drawer slide 200 in an extended position. The carrier 336 extends from the housing 306, pulled forward by the chain 322 or the pins 334. The chain 322 is not shown in FIG. 7*b*, but the two pins 334 of the connecting element 332 may be seen, with the pins 334 extending from the connecting element 332 and inserted in apertures 324 of the chain 322. As the drawer slide 202 closes, the spring 350 retracts the carrier 336 back into the housing 306.

Figure 8:
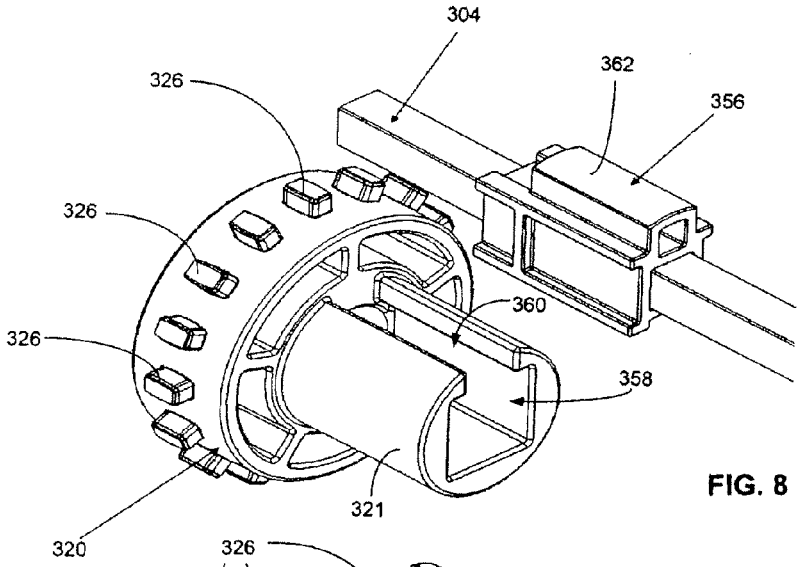
FIGS. 8-10 show a sprocket, a synchronizing element and an adapter connecting the synchronizing element to the sprocket in accordance with the present disclosure.
Figure 9:
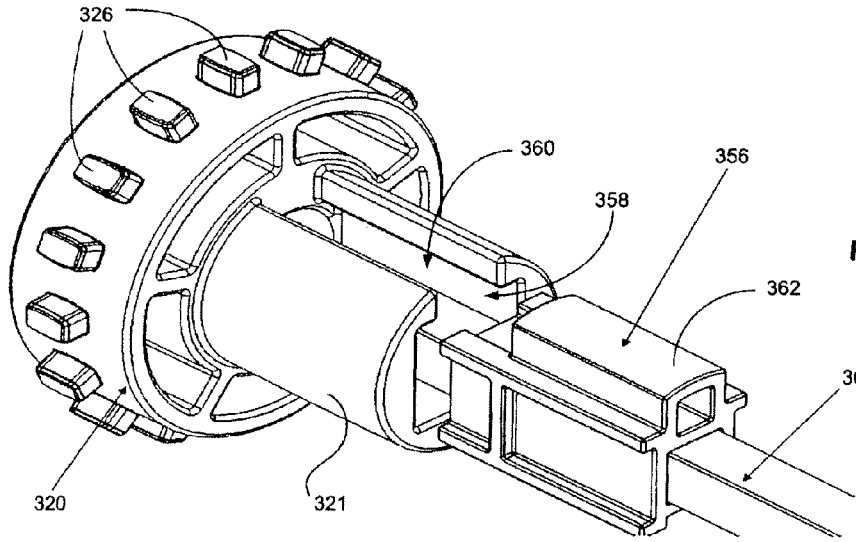
Figure 10:
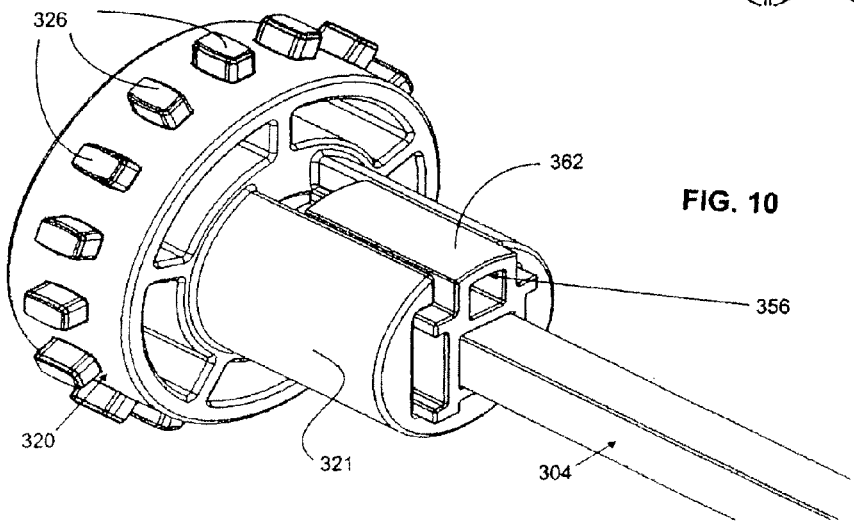

FIGS. 8-10 show in detail the sprocket 320 along with the synchronizing element 304 and an adapter 356. The sprocket 320 has a center shaft 321 with a cavity 358, in which the synchronizing element 304 is received. The synchronizing element 304 is shown to have a square cross section in the disclosed examples. However, the synchronizing element 304 can have any cross-sectional shape. The cavity 358 has a larger cross-section than the synchronizing element 304. In order to secure the synchronizing element 304 in the cavity 358, the adapter 356 is mounted on the synchronizing element 304 and is pressed into the cavity 358. The adapter 356 frictionally engages the cavity 358 to secure the synchronizing element 304 to the center shaft 321. The adapter 356 is shaped to correspond to the shape of the cavity 358. The center shaft 321 includes a slot 360 extending from the cavity 358 along the length of the center shaft 321. The adapter 356 is slidably mounted on the synchronizing element 304, with the adapter 356 having a key portion 362 along one side, with the key portion 362 configured to be fitted within the slot 360 of the center shaft 321. The adapter 356 may be integrally formed with the synchronizing element 304. For example, the synchronizing element 304 and the adapter 356 may be integrally formed by injection molding.

FIG. 8 shows the sprocket 320, synchronizing element 304, and adapter 356 adjacent the center shaft 321 of the sprocket 320, and FIGS. 9 and 10 show the synchronizing element 304 and adapter 356 inserted into the cavity 358 of the center shaft 321. With the synchronizing element 304 so mounted, rotation of the sprocket 320 causes rotation of the synchronizing element 304, and vice versa.

Figure 14:
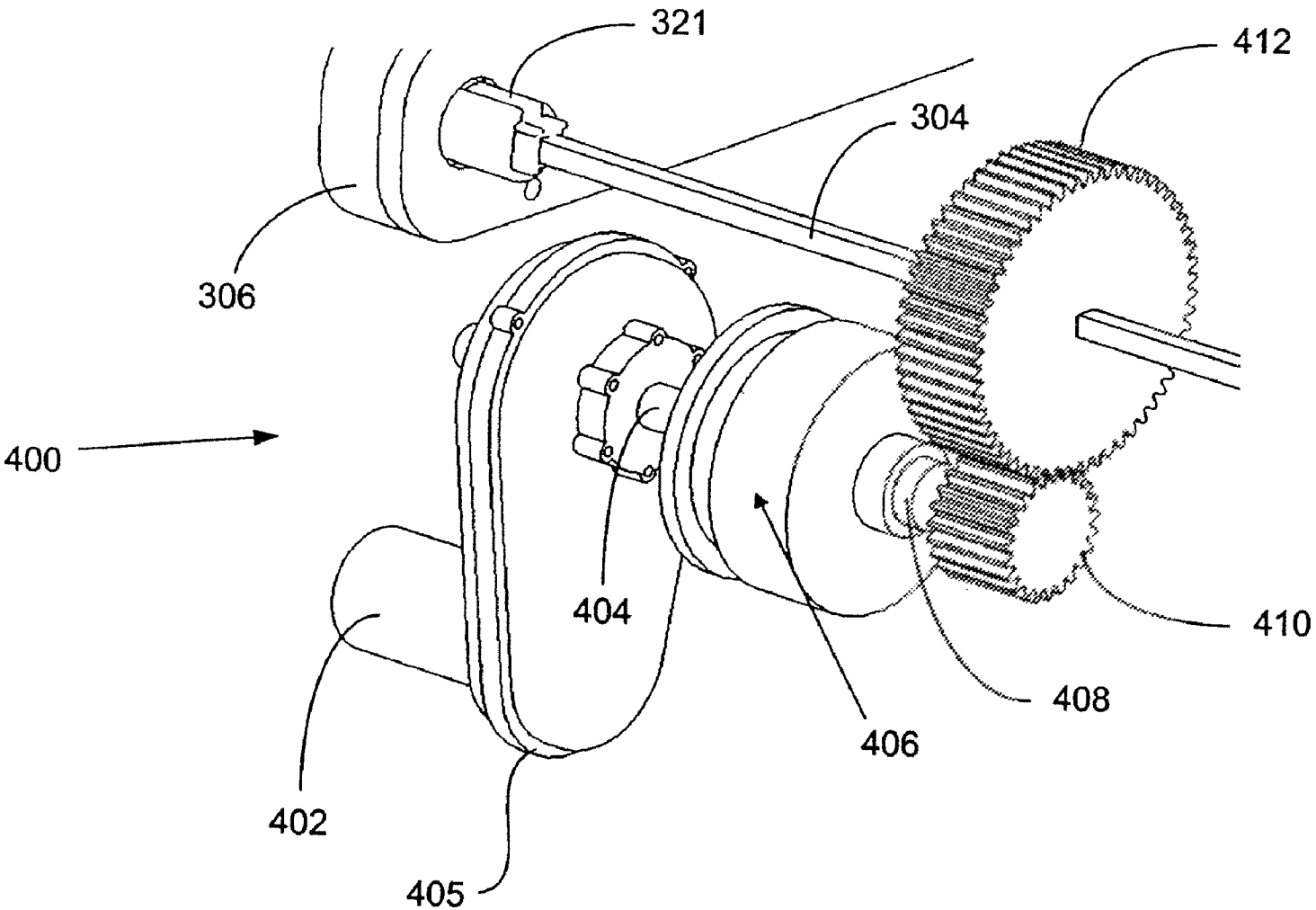
FIG. 14 shows a drive device according to the disclosure for extending and closing the drawer slide assemblies.

FIGS. 14 shows a motor assembly 400 coupled to the synchronizing element 304. Use of the motor assembly 400 allows for automatic opening and closing of the drawer, with the motor assembly 400 driving the synchronizing element 304. Because the synchronizing element 304 is coupled to the sprocket 320, which in turn drives the chain 322 and therefore the inner slide member 202 of each slide, the motor assembly 400 may be used for automatic opening and/or closing of the drawer slides 200, as well as any drawer mounted to the drawer slides 200. The motor assembly 400 includes an electric motor 402 which is coupled to a drive shaft 404 with belt(s), chain(s) or gears (not shown) housed in a housing 405. The drive shaft 404 is connected to a clutch 406 which when disengaged allows manual opening of the drawer. The clutch 406 is coupled to another drive shaft 408 having a drive gear 410. The drive gear 410 drives a driven gear 412, which is mounted on the synchronizing element. The gear ratio between the drive gear 410 and the driven gear 412 can be determined to provide a required speed and/or torque. The motor assembly 400 may be configured, by encoding circuitry, by timer circuitry, or by the use of limit switches, for example, to automatically stop when the drawer slides 200 are fully open or closed.

Operation of the drawer slides 202 with the synchronizing device 300 will now be described. In the closed position, the connecting element 332 is at the rear end of the housing 306. When the drawer is opened, the inner slide member 202 moves toward an extended position. Because the connecting element 332 is attached to the inner slide member 202, the connecting element 332 moves along with the inner slide member 202. The connecting element 332 moves the chain 322, which in turn rotates the sprocket 320 to rotate the synchronizing element 304. Because the synchronizing element 304 connects the sprockets 320 of the stabilization elements 302*a* and 302*b*, respectively, the extension of the drawer slides 200*a* and 200*b* is synchronized. Accordingly, if one side of the drawer is pulled or pushed with a larger force than the other side, the synchronizing device 300 ensures that both drawer slides 300 extend or close together in a synchronous manner without racking.

Figure 15:
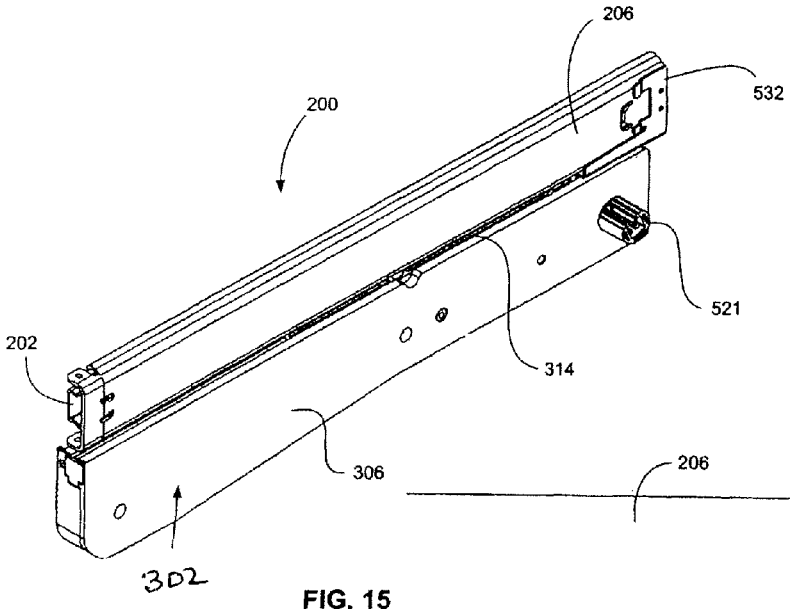
FIG. 15 shows an isometric view of a drawer slide assembly and a stabilization element in accordance with another embodiment of the disclosure shown from the drawer side.
Figure 17:
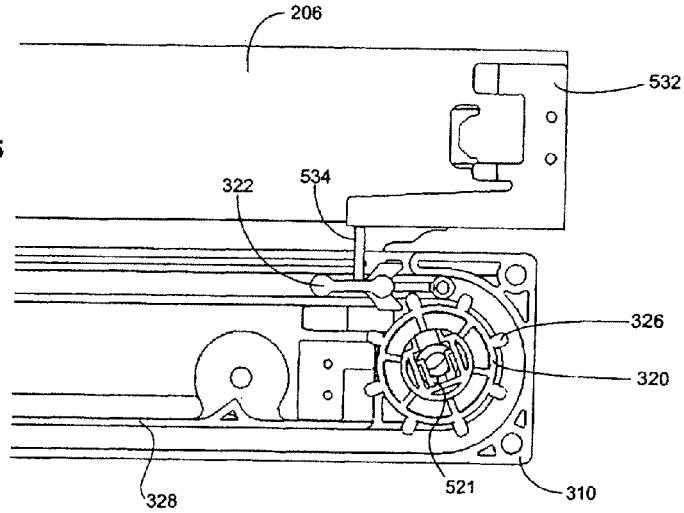
FIG. 17 shows a partial fragmentary view of a rear portion of the drawer slide assembly and the stabilization element of FIG. 15.
Figure 16:
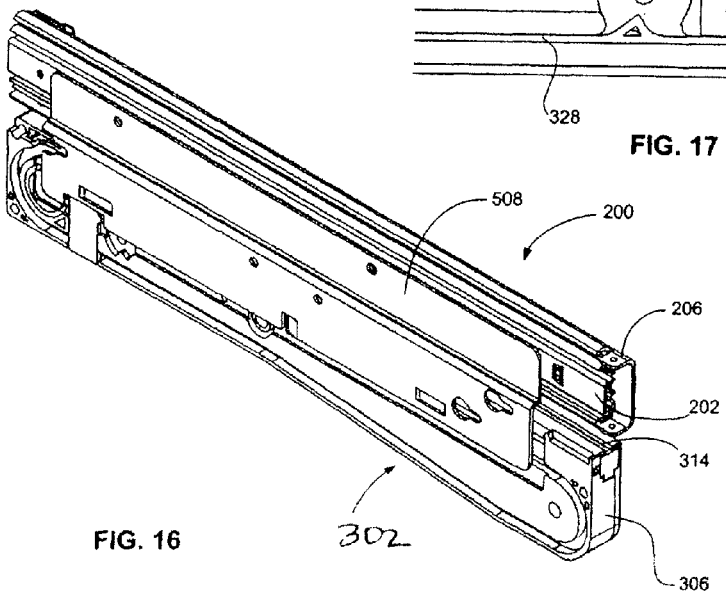
FIG. 16 shows an isometric view of a drawer slide assembly and a stabilization element in accordance with another embodiment of the disclosure shown from the cabinet side.

In the embodiment described above, the outer slide member 206 is attached to the cabinet or rack, while the inner slide member 202 is extendable relative to the outer slide member 206. In the embodiment of FIGS. 15-17, the drawer slide is a reverse mount slide, where the inner slide member 202 is attached to a cabinet or rack and therefore remains stationary relative to the outer slide member. As such, the outer slide member 206 is extendable relative to the inner slide member 202. A drawer or rack mounted equipment is then mounted on the outer slide member 206. Referring to FIG. 16, the housing 306 is attached to the inner slide member 202 with a connecting element 508. Thus, the housing is fixed and remains stationary with the inner slide member 202, while the intermediate slide member 204 and the outer slide member 206 are extendable.

Figure 18:
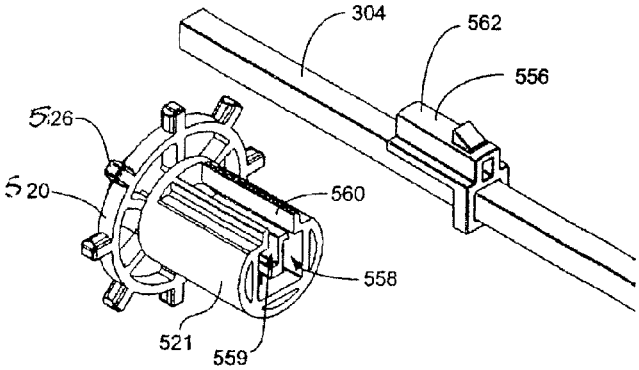
FIGS. 18-20 show a sprocket, a synchronizing element and an adapter connecting the synchronizing element to the sprocket in accordance with another embodiment of the present disclosure.
Figure 19:
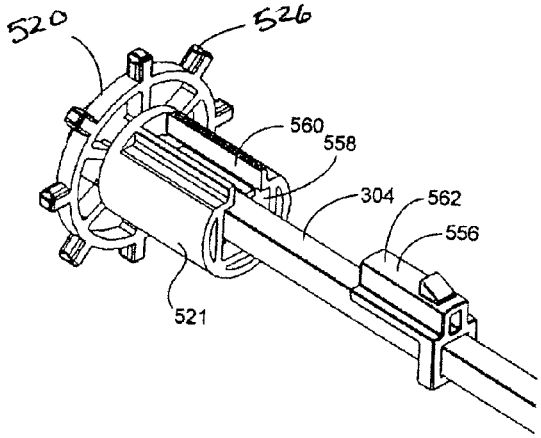
Figure 20:
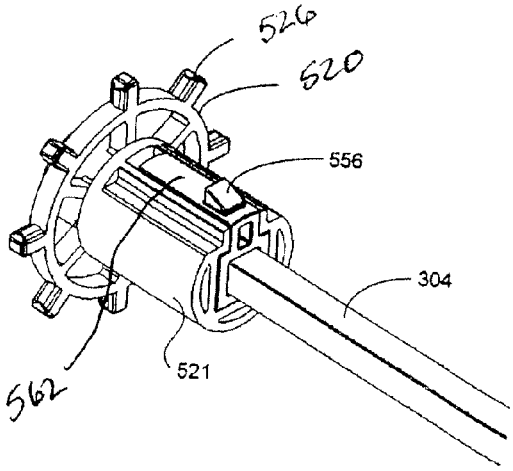

Referring to FIGS. 15-20, the parts of a second embodiment are shown assigned reference numbers in the 500's. These parts are similar or the same as those parts of the first embodiment which are assigned reference numbers in the 300's and have the same tenth and single digits. Referring to FIG. 17, a connecting element 532 is mounted on the outer slide member 206 and includes a pin 534 for engagement with an aperture 324 of the chain 322. The connecting element 532 may include two pins similar to the connecting element 332 of the first embodiment. Referring to FIGS. 18-20, a sprocket 520 with projections or teeth 526 and an adapter 556 according to another embodiment is shown. The sprocket 520 has a center shaft 521 with a cavity 558 for receiving the synchronizing element 304 with the adapter 556. The cavity 558 of this embodiment differs from the cavity 358 of the first embodiment in that a portion 559 of the cavity is shaped to directly receive the synchronizing element 304. Accordingly the adapter 556 key portion 562 of this embodiment is shaped to only frictionally engage the slot 560. However, the slot 560 may include larger side walls in order to provide increased frictional engagement with the adapter 558 key portion 562.

Figure 21:
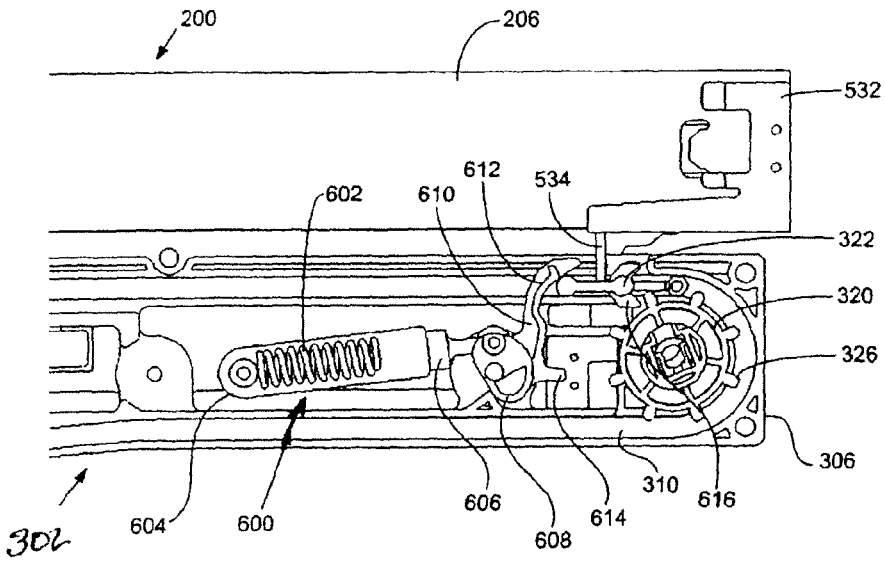
FIGS. 21-23 show a self close mechanism for the drawer slide assembly according to the present disclosure.
Figure 22:
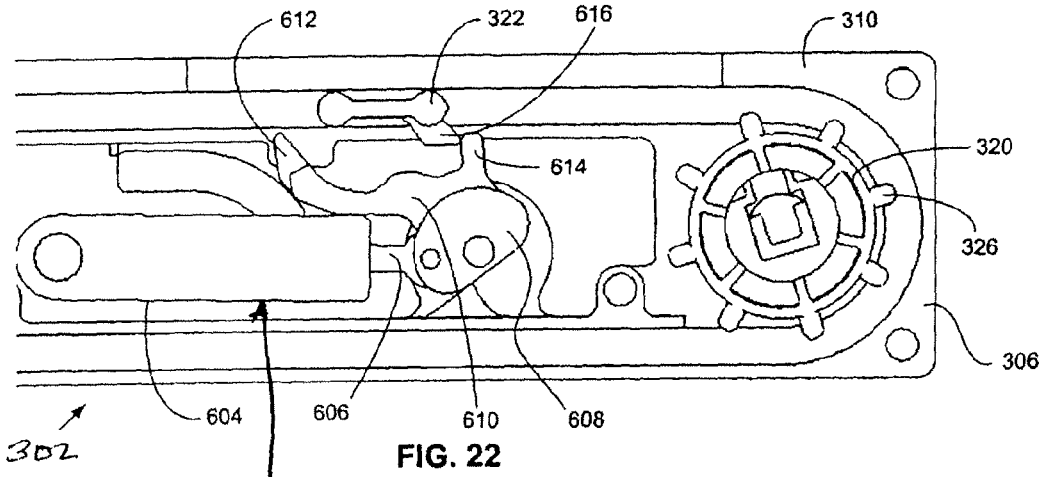
Figure 23:
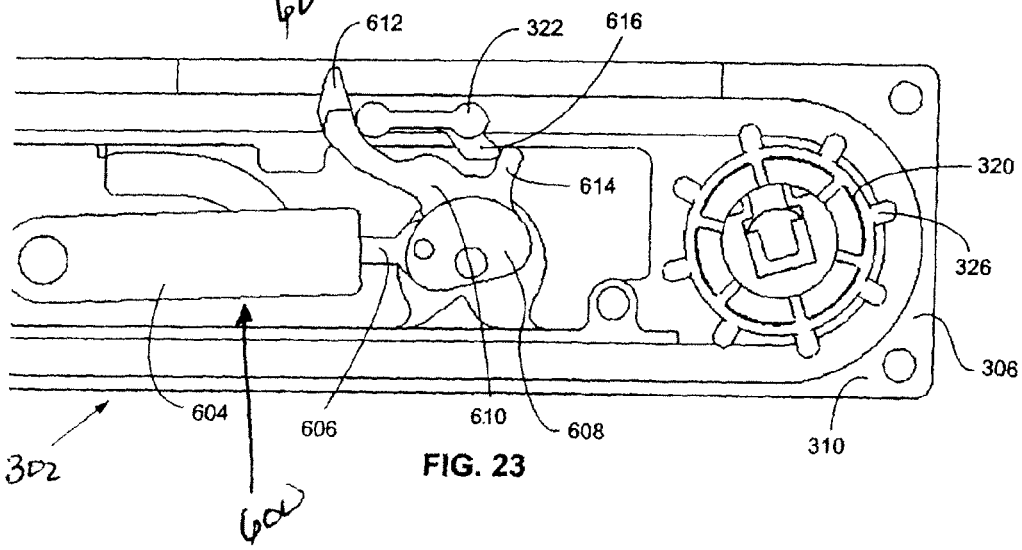

Referring to FIGS. 21-23, a self moving mechanism 600 according to an embodiment of the disclosure is shown. In the shown exemplary embodiment, the mechanism 600 is a self close mechanism. In other exemplary embodiments, the mechanism may be mounted to be a self opening mechanism. The self close mechanism 600 can be used with any of the embodiments of the drawer slides described above or other types of drawer slides. The self close mechanism 600 includes a spring 602 inside a cylinder 604. A piston 606 can move inside the cylinder 604 toward the spring 602 to compress the spring 602. Conversely, the spring 602 can expand to push the piston 606 out of the cylinder 604. The cylinder 604 is pivotally connected to the base 310 of the housing 306 and the piston 606 is connected to a rotatable cam 608. An actuation element 610 is connected to the cam 608 and can rotate with the cam 608. The actuation element 610 includes a first arm 612 and a second arm 614.

When the outer slide member 206 is in the closed position as shown in FIG. 21, the spring 602 is in a neutral position. When the outer slide member 206 is moved to the extended position, as shown in FIG. 22, the chain 322 pushes the first arm 612 to rotate the cam 608. Rotation of the cam 608 pushes the piston 606 in the cylinder to compress the spring 602. The actuation element 610 is then locked in the position shown in FIG. 22. When the outer slide member 206 is moved toward the closed position as shown in FIG. 23, a projection 616 on the chain 322 engages the second arm 614 to unlock the actuation element 610. The spring 602 expands to rotate the first arm 612 to thereby push the chain 322 to the closed position as shown in FIG. 21.

Figure 24:
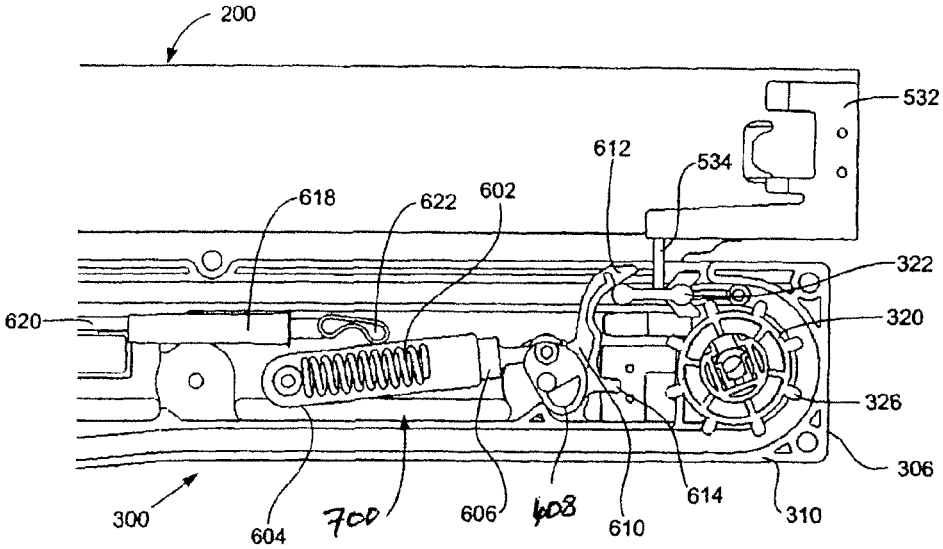
FIGS. 24-25 show the soft close mechanism for the drawer slide assembly according to the present disclosure.
Figure 25:
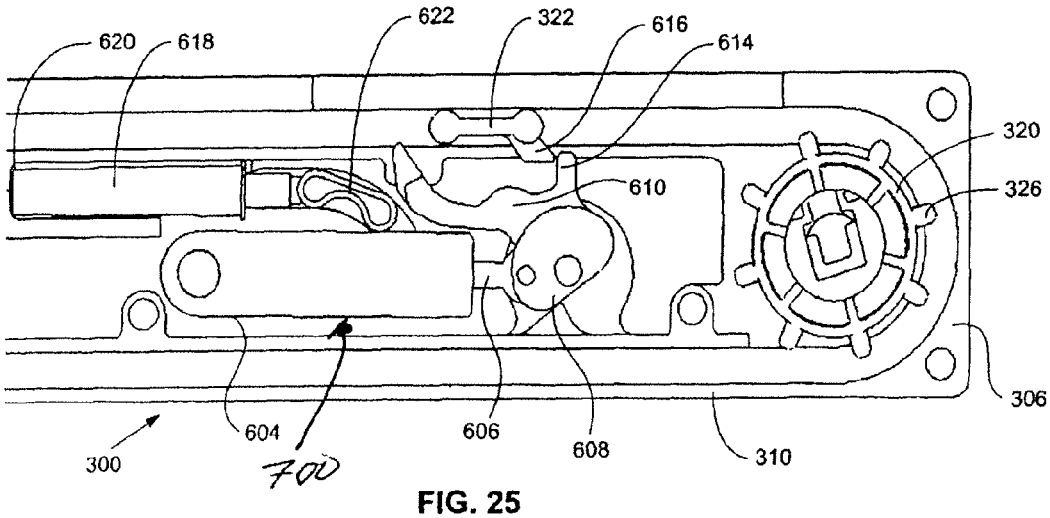

Referring to FIGS. 24-25, a soft close mechanism 700 is shown, which is similar to the self close mechanism 600 described above but also includes a dampening element 618. The soft close mechanism 700 can be used with any of the embodiments of the drawer slides described above or other types of drawer slides. The dampening element 618 has a first end 620 and a second end 622. The first end 620 is fixed to the base 310 and the second end 622 is connected to the cylinder 604. During the return of the outer slide member 206 from an extended position as shown in FIG. 25, the first arm 612 engages the chain 322 and pushes the chain 322 with the force of the spring 602 as shown in FIG. 23. However, as the spring 602 expands, the cylinder 604 moves with the rotation of the cam 608 and thereby compresses the dampening element 618. The dampening element 618 dampens of softens the return of the outer drawer slide 206 to the closed position as shown in FIG. 24.

The self close mechanism and the soft close mechanism are described above with respect to the drawer slide assembly configuration of FIGS. 15-17. However, the self close mechanism and the soft close mechanism can be used with the drawer slide assembly of FIGS. 2-6. Similarly, all of the components described above can be used in the embodiments described herein and are not limited to a particular embodiment.

While a particular form of the disclosure has been illustrated and described, it will be apparent that various modifications can be made without departing from the spirit and scope of the disclosure. Accordingly, it is not intended that the disclosure be limited, except as by the appended claims.

What is claimed is:

1. A synchronized slide system comprising a synchronizing device and a pair of slide assemblies, each slide assembly having at least a first slide member moveable relative to a second slide member, the synchronizing device comprising, a first stabilization element coupled to the second slide member of one of the slide assemblies and a second stabilization element coupled to the second slide member of the other slide assembly, each stabilization element comprising:

a housing fixed to the second slide member of a corresponding one of the slide assemblies;

a connecting element extending from the first slide member of a corresponding one of the slide assemblies, wherein the connecting element and the first slide member are moveable together along the housing;

a flexible member coupled to the connecting element, said flexible member and the connecting element being moveable together;

a sprocket coupled to the flexible member, the sprocket and the flexible member being moveable together; and a linking element coupling the sprocket of the first stabilization element and the sprocket of the second stabilization element to synchronize movements of the first slide members.

2. The synchronized slide system of claim 1 wherein the flexible member of each stabilization element comprises a plurality of apertures engaging with at least a projection on the sprocket of the corresponding stabilization element.

3. The synchronized slide system of claim 2 wherein the connecting element of each stabilization element comprises at least one pin engaging at least one of the apertures of the flexible member of the corresponding stabilization element.

4. The synchronized slide system of claim 1 wherein the sprocket of each stabilization element comprises a center shaft having a cavity with a slot, wherein each stabilization element comprises an adapter having a key portion configured to be received in the slot of the cavity, and wherein each of the adapters connects to a corresponding end portion of the linking element and is received in the cavity of the corresponding sprocket to connect the corresponding end portion of the linking element with a corresponding sprocket.

5. The synchronized slide system of claim 1 wherein each stabilization element comprises a housing, and wherein the flexible member and the sprocket are housed in the housing.

6. The synchronized slide system of claim 5 wherein each stabilization element comprises a carrier element configured to extend from the inside of the housing to the outside of the housing to support the flexible member when the flexible member extends outside of the housing.

7. The synchronized slide system of claim 6 wherein each stabilization element comprises a spring device configured to return the carrier element from outside of the housing to the inside of the housing.

8. The synchronized slide system of claim 5 wherein the housing of each stabilization element comprises a slot gap configured to receive at least a portion of the connecting element.

9. The synchronized slide system of claim 5 wherein the housing of each stabilization element comprises a guide path configured to guide movement of the flexible member along the guide path.

10. The synchronized slide system of claim 1 wherein the linking element extends transverse to an extension direction of the slide members.

11. The synchronized slide system of claim 1 wherein the linking element is stationary relative to the direction of movement of the first slide members.

12. The of claim 1 further comprising motor for rotating said linking member.

13. A slide system for a cabinet or rack, the slide system comprising:

a first slide assembly comprising a first slide member coupled to the cabinet or rack, said first slide member remaining stationary relative to the cabinet or rack, and at least a second slide member moveable relative to the first slide member;

a second slide assembly comprising a first slide member coupled to the cabinet or rack, said first slide member of the second slide assembly remaining stationary relative to the cabinet or rack, and at least a second slide member moveable relative to the first slide member of the second slide assembly; and a synchronizing device comprising:

a first stabilization element coupled to the first slide member of the first slide assembly;

at least a first stabilization element first coupling element extending between the second slide member of the first slide assembly and the first stabilization element and being moveable with the second slide member of the first slide assembly along a slot in the first stabilization element;

a second stabilization element coupled to the first slide member of the second slide assembly;

at least a second stabilization element first coupling element extending between the second slide member of the second slide assembly and the second stabilization element and being moveable with the second slide member of the second slide assembly, and moveable along a slot in the second stabilization element; and a linking element extending between the first stabilization element and the second stabilization element and operatively coupling the first coupling element of the first stabilization element and the first coupling element of the second stabilization element to synchronize movements of the second slide member of the first slide assembly and the second slide member of the second slide assembly, wherein the linking element is stationary relative to the direction of movement of the moveable slide members.

14. The slide system of claim 13 wherein each of the first slide assembly and the second slide assembly comprises an intermediate slide member, wherein the intermediate slide member is slidably supported within the first slide member and the second slide member is slidably supported within the intermediate slide member.

15. The slide system of claim 13 wherein each of the first slide assembly and the second slide assembly comprises an intermediate slide member, wherein the intermediate slide member is slidably supported within the second slide member and the first slide member is slidably supported within the intermediate slide member.

16. The slide system of claim 13 further comprising a motorized drive configured to drive the linking element and thereby the first coupling elements.

17. A cabinet or rack comprising the slide system according to claim 13 wherein the cabinet or rack comprises a first support member and a second support member laterally opposite the first support member, and wherein the first slide member of the first slide assembly is coupled on the first support member and the second slide member of the second slide assembly is coupled on the second support member.

18. A synchronizing device for use with a pair of slide assemblies, each slide assembly having at least a first slide member moveable relative to a second slide member along a direction, the synchronizing device comprising:

a first flexible member for coupling with and for being moveable with the first slide member of a first of said slide assemblies;

a second flexible member for coupling with and for being moveable with the first slide member of a second of said slide assemblies;

a first sprocket coupled to the first flexible member, the first sprocket and the first flexible member being moveable together;

a second sprocket coupled to the second flexible member, the second sprocket and the second flexible member being moveable together; and a linking element coupling the first sprocket with the second sprocket to synchronize movements of the first slide members, and for being translationally fixed along the direction.

19. A synchronizing device for use with a pair of slide assemblies, each slide assembly having at least a first slide member moveable relative to a second slide member, the synchronizing device comprising:

a first stabilization element configured to be fixed relative to the second slide member of one of the slide assemblies and comprising at least a first coupling element being moveable with the first slide member of the slide assembly;

a second stabilization element configured to be fixed relative to the second slide member of the other slide assembly and comprising at least a first coupling element being moveable with the moveable slide member of the other slide assembly; and a linking element extending between the first stabilization element and the second stabilization element and operatively coupling the first coupling element of the first stabilization element and the first coupling element of the second stabilization element to synchronize movements of the first coupling element of the first stabilization element and the first coupling element of the second stabilization element, said linking element being translationally fixed relative to the first and second stabilization elements, wherein each of the first stabilization element and the second stabilization element comprises a second coupling element connected to the first coupling element and operatively coupling the first coupling element to the linking element, and wherein the second coupling element of each stabilization element is a flexible member comprising a plurality of apertures, and wherein the first coupling element is a bracket comprising at least one projection configured to engage in at least one of the apertures of the flexible member.

20. A synchronizing device for use with a pair of slide assemblies, each slide assembly having at least a first slide member moveable relative to a second slide member, the synchronizing device comprising:

a first stabilization element configured to be fixed relative to the second slide member of one of the slide assemblies and comprising at least a first coupling element for being moveable with the first slide member of the slide assembly;

a second stabilization element configured to be fixed relative to the second slide member of the other slide assembly and comprising at least a first coupling element for being moveable with the first slide member of the other slide assembly; and a linking element extending between the first stabilization element and the second stabilization element and operatively coupling the first coupling element of the first stabilization element and the first coupling element of the second stabilization element to synchronize movements of the first coupling element of the first stabilization element and the first coupling element of the second stabilization element, said linking element being translationally fixed relative to the first and second stabilization elements, wherein each of the first stabilization element and the second stabilization element comprises a second coupling element connected to the first coupling element and operatively coupling the first coupling element to the linking element, wherein each stabilization element comprises a housing, wherein the second coupling element is housed in the housing, and wherein the housing includes a guide path configured to guide movement of the second coupling element along the guide path.

21. The synchronizing device of claim 20 wherein each of the first stabilization element and the second stabilization element comprises a third coupling element connected to the second coupling element and operatively coupling the second coupling element to the linking element.

22. The synchronizing device of claim 21 wherein the second coupling element of each stabilization element is a flexible member comprising a plurality of linearly arranged apertures, and wherein the third coupling element is a sprocket comprising a plurality of radially arranged projections configured to engage the apertures of the flexible member.

23. The synchronizing device of claim 21 wherein the third coupling element of each stabilization element is rotatable about a shaft, and wherein the linking element is connected to the third coupling element.

24. The synchronizing device of claim 20 wherein each stabilization element comprises a carrier element configured to support the second coupling element when the second coupling element extends outside the housing.

25. The synchronizing device of claim 24 wherein each stabilization element comprises a spring device configured to return the carrier element from the outside of the housing to the inside of the housing.

26. A synchronizing device for use with a pair of slide assemblies, each slide assembly having at least a first slide member moveable relative to a second slide member, the synchronizing device comprising:

a first stabilization element configured to be translationally fixed relative to the second slide member of one of the slide assemblies and comprising at least a first coupling element for being moveable with the first slide member of the slide assembly;

a second stabilization element configured to be translationally fixed relative to the second slide member of the other slide assembly and comprising at least a first coupling element for being moveable with the first slide member of the other slide assembly; and a linking element extending between the first stabilization element and the second stabilization element and operatively coupling the first coupling element of the first stabilization element and the first coupling element of the second stabilization element to synchronize movements of the first coupling element of the first stabilization element and the first coupling element of the second stabilization element, said linking element being translationally fixed relative to the first and second stabilization elements, wherein each of the first stabilization element and the second stabilization element comprises a second coupling element connected to the first coupling element and operatively coupling the first coupling element to the linking element, wherein each of the first stabilization element and the second stabilization element comprises a third coupling element connected to the second coupling element and operatively coupling the second coupling element to the linking element, wherein the second coupling element of each stabilization element is a flexible member comprising a plurality of linearly arranged apertures, and wherein the third coupling element is a sprocket comprising a plurality of radially arranged projections configured to engage the apertures of the flexible member.

27. A synchronizing device for use with a pair of slide assemblies, each slide assembly having at least a first slide member moveable relative to a second slide member, the synchronizing device comprising:

a first stabilization element configured to be translationally fixed relative to the second slide member of one of the slide assemblies and comprising at least a first coupling element for being moveable with the first slide member of the slide assembly;

a second stabilization element configured to be translationally fixed relative to the second slide member of the other slide assembly and comprising at least a first coupling element for being moveable with the first slide member of the other slide assembly; and a linking element extending between the first stabilization element and the second stabilization element and operatively coupling the first coupling element of the first stabilization element and the first coupling element of the second stabilization element to synchronize movements of the first coupling element of the first stabilization element and the first coupling element of the second stabilization element, said linking element being translationally fixed relative to the first and second stabilization elements, wherein each of the first stabilization element and the second stabilization element comprises a second coupling element connected to the first coupling element and operatively coupling the first coupling element to the linking element, wherein each of the first stabilization element and the second stabilization element comprises a third coupling element connected to the second coupling element and operatively coupling the second coupling element to the linking element, and wherein each stabilization element comprises an adapter configured to connect the linking element to the third coupling element.

28. The synchronizing device of claim 27 wherein the adapter is integrally formed with the linking element.

29. A synchronizing device for use with a pair of slide assemblies, each slide assembly having at least a first slide member moveable relative to a second slide member, the synchronizing device comprising:

a first stabilization element configured to be translationally fixed relative to the second slide member of one of the slide assemblies and comprising at least a first coupling element for being moveable with the first slide member of the slide assembly;

a second stabilization element configured to be translationally fixed relative to the second slide member of the other slide assembly and comprising at least a first coupling element for being moveable with the first slide member of the other slide assembly; and a linking element extending between the first stabilization element and the second stabilization element and operatively coupling the first coupling element of the first stabilization element and the first coupling element of the second stabilization element to synchronize movements of the first coupling element of the first stabilization element and the first coupling element of the second stabilization element, said linking element being translationally fixed relative to the first and second stabilization elements, wherein each of the first stabilization element and the second stabilization element comprises a second coupling element connected to the first coupling element and operatively coupling the first coupling element to the linking element, and wherein each stabilization element comprises a housing configured to couple to the second slide of the corresponding slide member.

30. A synchronizing device for use with a pair of slide assemblies, each slide assembly having at least a first slide member moveable relative to a second slide member, the synchronizing device comprising:

a first stabilization element configured to be fixed relative to the second slide member of one of the slide assemblies and comprising at least a first coupling element for being moveable with the first slide member of the slide assembly;

a second stabilization element configured to be fixed relative to the second slide member of the other slide assembly and comprising at least a first coupling element for being moveable with the first slide member of the other slide assembly;

a linking element extending between the first stabilization element and the second stabilization element and operatively coupling the first coupling element of the first stabilization element and the first coupling element of the second stabilization element to synchronize movements of the first coupling element of the first stabilization element and the first coupling element of the second stabilization element, said linking element being translationally fixed relative to the first and second stabilization elements, wherein each of the first stabilization element and the second stabilization element comprises a second coupling element connected to the first coupling element and operatively coupling the first coupling element to the linking element; and a self moving mechanism coupled in said first stabilization element and comprising, a piston, and an actuation element comprising an arm, wherein the arm engages the second coupling element for moving the second coupling element of said first stabilization element.

31. The synchronizing device of claim 30 wherein the self moving mechanism further comprises:

a spring for urging the piston; and a cam coupled to the actuation element, wherein the piston rotates the cam for rotating the actuation element and thus moving the actuation element arm.

32. The synchronizing device of claim 31 wherein the piston has a portion sliding within a piston housing and wherein said piston housing is pivotally coupled to the first stabilization element.

33. The synchronizing device of claim 32 wherein the second coupling element includes a projection for engaging a second arm of said actuation element.

34. The synchronizing device of claim 32 further comprising a dampener coupled to the piston housing for dampening the movement of the piston housing.

* * * * *

UNITED STATES PATENT AND TRADEMARK OFFICE

CERTIFICATE OF CORRECTION

PATENT NO. : 8,152,250 B2
APPLICATION NO. : 12/537975
DATED : April 10, 2012
INVENTOR(S) : Jose Roberto Aguilar Ante et al.

It is certified that error appears in the above-identified patent and that said Letters Patent is hereby corrected as shown below:

In the Claims

Column 10, Claim 12, line 31. After "The"

Insert -- synchronized slide system --

Column 10, Claim 12, line 31. After "comprising"

Insert -- a --

Signed and Sealed this
Twenty-eighth Day of August, 2012

David J. Kappos

David J. Kappos
*Director of the United States Patent and Trademark Office*